US007204177B1

(12) United States Patent
Garner et al.

(10) Patent No.: US 7,204,177 B1
(45) Date of Patent: Apr. 17, 2007

(54) MAGNETIC DEVICE FOR ATTRACTING AND RETAINING FASTENERS

(75) Inventors: Timothy D. Garner, Kokomo, IN (US); Steven P. Thomas, Westfield, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/417,529

(22) Filed: May 4, 2006

(51) Int. Cl.
*B25B 23/08* (2006.01)

(52) U.S. Cl. ..... 81/451

(58) Field of Classification Search ..... 81/451, 81/436, 900, 125, 13
See application file for complete search history.

(56) References Cited

U.S. PATENT DOCUMENTS

| | | | | |
|---|---|---|---|---|
| 2,782,822 | A * | 2/1957 | Clark | 81/451 |
| 5,724,873 | A | 3/1998 | Hillinger | |
| 5,861,789 | A * | 1/1999 | Bundy et al. | 81/451 |
| 6,094,119 | A * | 7/2000 | Reznik et al. | 335/284 |
| 6,209,426 | B1 | 4/2001 | Takahashi | |
| 6,499,168 | B1 * | 12/2002 | Anderson | 81/451 |
| 7,051,630 | B2 * | 5/2006 | Lee | 81/451 |
| 2005/0098002 | A1 * | 5/2005 | Holland-Letz | 81/451 |
| 2005/0166725 | A1 | 8/2005 | Chen | |

OTHER PUBLICATIONS

Agents Private International Ltd., http://www.agtprint.com/s16/14, pp. 1-3 (Mar. 22, 2006).
Screw Products, Inc., http://www.screw-products.com/drive-bits.htm, pp. 1-4 (May 3, 2006).
EasyScrew, http://www.easyscrew.net, pp. 1-3 (May 3, 2006).
EasyScrew, http://www.easyscrew.net/magnetic.php, pp. 1-2 (Mar. 28, 2006).
EasyScrew, http://www.easyscrew.com/setup.php, pp. 1-2 (Mar. 28, 2006).
Global Sources, http://www.globalsources.com/manufacturers/Magnetic-Screwdriver.html, pp. 1-4 (2006).
Dimar Canada Ltd., http://dimarcanada.com/products/product_details.php?familyIDVar=7&categoryIDVar=99&groupIDVar=358, p. 1 (2005).
Eazypower, http://www.eazypower.com/about.asp, pp. 1-3 (2002).
Eazypower, http://www.eazypower.com/protected/bigitem.asp?SKU=81198, p. 1 (2002).
Aubuchon Hardware, http://power-tools.hardwarestore.com/54-394-magnetic-bit-holder/stayzon-magnetic-screw-holder-5-16-631226.aspx, pp. 1-3 (2006).
Photos of Stanley Multi-bit Ratchet Screwdriver, Contractor Grade (1998).

* cited by examiner

*Primary Examiner*—Hadi Shakeri
(74) *Attorney, Agent, or Firm*—Jimmy L. Funke

(57) ABSTRACT

A magnetic device for attracting and retaining a fastener which has a bit, a generally ring-shaped keeper having a bottom surface, at least some portion of which bottom surface is magnetized, at least one pair of magnets, each pair of magnets having two magnets with alternating poles, adjacent to the magnetic bottom surface of the keeper and arranged around the bit such that an even number of magnets with alternating poles is arranged around the bit, and a non-magnetic holder that secures the keeper and the magnets and surrounds the bit. The magnets provide magnetic flux to the keeper and the fastener. Each pair of adjacent magnets provides a closed magnetic flux path through a first magnet of the pair, the keeper, a second magnet of the pair, and the fastener. The location of the magnetic device along the bit may be adjustable or fixed.

23 Claims, 2 Drawing Sheets

MAGNETIC DEVICE FOR ATTRACTING AND RETAINING FASTENERS

TECHNICAL FIELD

The present invention generally relates to devices for attracting and retaining fasteners, and more particularly relates to fastener attracting and retaining devices employing magnetic flux.

BACKGROUND OF THE INVENTION

Magnetic devices for attracting and retaining fasteners are commonly used with fastener drivers. For example, manual screwdrivers and automated drills frequently utilize magnetic devices to attract threaded fasteners (e.g., screws) to bits and to retain screws on bits during the screw driving process. Such devices often employ a bit for engaging the socket of a fastener and one or more magnets for attracting and holding the fastener to and on the bit.

Known magnetic devices generally do not efficiently attract and retain fasteners. Currently available magnetic devices typically use one or more large, powerful magnets to magnetize a bit so that the magnetized bit attracts and retains a fastener. Magnetization of a bit generally causes high lateral force generally perpendicular to the bit, but little axial force along the length of the bit to keep the bit fully engaged in the socket of the fastener. Magnetization of the bit also tends to magnetize the fastener. When the fastener is magnetized, complications may occur during attraction of the fastener to the bit. A magnetized fastener is magnetically attracted to other magnetic items in its vicinity, such as fastener feeders or fastener containers. The fastener's magnetic attraction to other magnetic items in its vicinity reduces the reliability of pickup (i.e., attraction and retention) of the fastener by the magnetized bit.

Further, known magnetic devices for attracting and retaining fasteners typically are not adjustably and reliably affixed to fastener driving assemblies. Currently available magnetic devices for attracting and retaining fasteners are attached to fastener driving assemblies with set screws or via the use of magnetic force. Magnetic devices attached to fastener driving assemblies with set screws or magnetic force tend to slip and thus to lose the location of the magnetic device in relation to the bit tip.

Accordingly, it is therefore desirable to provide for a device for attracting and retaining fasteners that may solve the aforementioned problems and provide attracting and retaining advantages over conventional attraction and retention devices.

SUMMARY OF THE INVENTION

In accordance with the teachings of the present invention, a magnetic device is provided for attracting and retaining a fastener. The magnetic device can be used in a variety of applications including, but not limited to, fastener driving processes.

According to one aspect of the present invention, the magnetic device includes a bit having a proximate end adapted for engagement with the fastener, and a generally ring-shaped keeper surrounding at least a portion of the proximate end of the bit. The keeper has a bottom surface and a magnetic portion at at least some portion of the bottom surface of the keeper. The magnetic device also includes at least one pair of magnets adjacent to at least some part of the magnetic portion of the bottom surface of the keeper and arranged around the proximate end of the bit such that all magnets arranged around the proximate end of the bit have alternating poles and such that an even number of magnets is arranged around the proximate end of the bit. Each pair of magnets has first and second magnets with alternating poles, wherein the at least one pair of magnets provide magnetic flux to the keeper and the fastener. Each pair of adjacent magnets provides a closed magnetic flux path through the first magnet of the pair, the keeper, the second magnet of the pair, and the fastener. The magnetic device further includes a non-magnetic holder at least partially surrounding the bit, the holder securing the keeper and the at least one pair of magnets.

According to another aspect of the present invention, the magnetic device includes a bit that has a proximate end adapted for engagement with a fastener, and a generally ring-shaped keeper. The keeper surrounds a portion of the bit. The keeper has a bottom surface and a magnetic portion at at least some portion of the bottom surface of the keeper. The magnetic device also includes at least one pair of magnets adjacent to at least some part of the magnetic portion of the bottom surface of the keeper. The at least one pair of magnets is arranged around the proximate end of the bit, such that all magnets around the proximate end of the bit have alternating poles and such that an even number of magnets is arranged around the proximate end of the bit. Each pair of magnets has first and second magnets with alternating poles, wherein the at least one pair of magnets provides magnetic flux to the keeper and the fastener. Each pair of adjacent magnets provides a closed magnetic flux path through a first magnet of the pair, the keeper, a second magnet of the pair, and the fastener. The magnetic device further includes a non-magnetic holder for securing the keeper and the at least one pair of magnets. The holder at least partially surrounds the bit and has a generally cylindrical enclosure and a base having an aperture.

According to further aspects of the present invention, the magnetic device may also include an inner sleeve adjacent to a portion of the bit and surrounding a portion of the bit and a clamping sleeve for securing the holder and the keeper to the inner sleeve, wherein the holder is adjustable relative to the clamping sleeve, the keeper is adjustable relative to the inner sleeve, and the keeper is adjustable relative to the clamping sleeve.

Accordingly, the magnetic device for attracting and retaining fasteners provides one or more of the following advantages: the device uses an axial magnetic force to attract and retain a fastener; the device efficiently utilizes magnetic force to attract and retain a fastener; the device does not magnetize the fastener to such a degree that the fastener's attraction to other magnetic objects in its vicinity, such as a fastener feeder or container, impairs the magnetic device's ability to reliably attract and retain the fastener; and the device utilizes focused flux to attract and retain a fastener.

These and other features, advantages, and objects of the present invention will be further understood and appreciated by those skilled in the art by reference to the following specification, claims, and appended drawings.

BRIEF DESCRIPTION OF THE DRAWINGS

The present invention will now be described, by way of example, with reference to the accompanying drawings, in which.

DETAILED DESCRIPTION OF PREFERRED EMBODIMENTS

Figures 1, 2, 3:
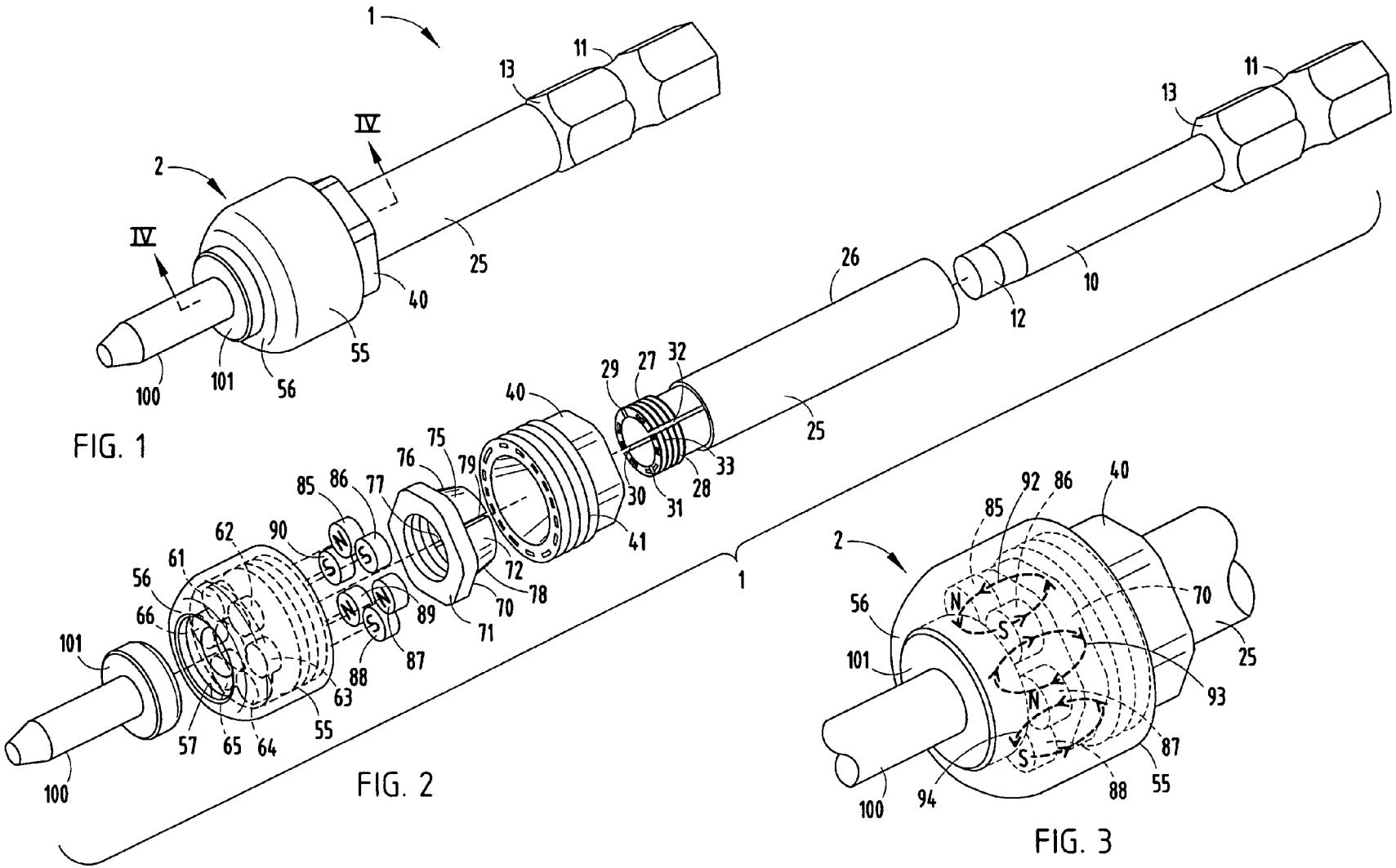
FIG. 1 is a perspective view of a fastener driving assembly embodying a magnetic device according to a first embodiment of the present invention.
FIG. 2 is an exploded view with hidden lines of the fastener driving assembly shown in FIG. 1.
FIG. 3 is an enlarged view with hidden lines of the magnetic device shown in FIG. 1.

Referring now to FIGS. 1 and 2, a fastener driving assembly 1 is illustrated that embodies one embodiment of a magnetic device 2 for attracting and retaining a fastener. The magnetic device 2 may be configured to attract and retain any of a variety of fasteners, such as screws or bolts, which are forcibly driven into a work piece via the driving assembly 1. The fastener driving assembly 1 may be an automated drill or any other assembly desirable of employing a device to attract and retain a fastener.

The magnetic device 2 includes an elongated bit 10 adjacent to and partially within an inner sleeve 25. An outer clamping sleeve 40 encircles inner sleeve 25. The magnetic device 2 has a holder 55 that surrounds a portion of the clamping sleeve 40. A fastener 100, such as a screw, is shown held at the base 56 of holder 55. The fastener 100 may have a shaped head 101 configured to be engaged by a similar shaped mating element of bit 10.

Bit 10 has a distal end 11 and a proximate end 12. Inner sleeve 25 has a distal end 26 and a proximate end 27. The distal end 26 of inner sleeve 25 mates with a shoulder 13 of bit 10. A collet 28 is at the proximate end 27 of inner sleeve 25. Collet 28 has four axial slits 29, 30, 31, and 32 and an exterior thread 33. Clamping sleeve 40 has exterior threads 41. The clamping sleeve 40 may be made of bronze, according to one example.

The magnetic device 2 also includes a ring-shaped keeper 70 surrounding at least a portion of the proximate end 12 of the bit 10. The keeper 70 has a bottom surface 71. Keeper 70 also has a magnetic portion at at least some part of the bottom surface 71 of the keeper 70. The keeper 70 has an external axial taper 72 in the direction of distal end 11 of bit 10. Collet 75 of keeper 70 has four axial slits 76, 77, 78, and 79.

The magnetic device 2 further has a plurality of magnets 85, 86, 87, 88, 89, and 90 arranged around proximate end 12 of bit 10 such that they have alternating magnetic poles (North, South). An even number of magnets 85, 86, 87, 88, 89, and 90 are arranged around proximate end 12 of bit 10. Magnets 85, 86, 87, 88, 89, and 90 are adjacent to at least some part of the magnetized portion of bottom surface 71 of keeper 70. In the embodiment shown, the magnets 85, 86, 87, 88, 89, 90 are circular or disk-shaped. According to other embodiments, magnets that are not circular or disk-shaped may be used in the magnetic device 2 according to the present invention. For example, one or more pairs of crescent-shaped magnets may be used in the magnetic device 2 according to the present invention. Magnets 85, 86, 87, 88, 89, and 90 may be comprised of Neodimium, Boron, or one or more other high magnetic-power materials.

Magnets 85, 86, 87, 88, 89, and 90 fit within recesses 61, 62, 63, 64, 65, and 66 of a holder 55. The holder 55 is not magnetic and at least partially surrounds the bit 10. Holder 55 secures the keeper 70 and the magnets 85, 86, 87, 88, 89, and 90 in place within the magnetic device 2. Holder 55 has a base 56 and an aperture 57 located in the base 56 of holder 55.

As seen in FIG. 3, magnetic flux paths 92, 93, 94 are generated by arranged pairs of magnets. The flux paths 92, 93, 94 essentially follow closed loop paths that pass through the first magnet of each pair of adjacent magnets with alternating poles, the magnetic portion of keeper 70, the second magnet of each pair of adjacent magnets with alternating poles, and the fastener 100. The flux path between magnet 88, the magnetic portion of keeper 70, magnet 89, and fastener 100 is not shown in FIG. 3. Similarly, the flux path between magnet 90, the magnetic portion of keeper 70, magnet 85, and fastener 100 is not shown in FIG. 3. And, the flux path between magnet 90, the magnetic portion of keeper 70, magnet 89, and fastener 100 is not shown in FIG. 3. The term flux path, as used in this specification, refers to the magnetic flux flow irrespective of the direction of the flux flow. In general, flux lines are assumed to emerge from a magnet at the North pole and to enter a magnet at the opposite South pole.

A magnetic force exists at each flux path 92, 93, 94, the flux path between magnets 88 and 89, the flux path between magnets 90 and 85, and the flux path between magnets 89 and 90. The magnetic forces at each flux path 92, 93, 94, the flux path between magnets 88 and 89, the flux path between magnets 90 and 85, and the flux path between magnets 89 and 90, attract and retain a fastener 100 to the proximate end 12 of bit 10. In the ideal case, bit 10 is not magnetized and the flux paths 92, 93, 94, the flux path between magnets 88 and 89, the flux path between magnets 90 and 85, and the flux path between magnets 89 and 90, achieve axial magnetic flux focused at the fastener head 101. Even if bit 10 is magnetized, the magnetic force at flux paths 92, 93, 94, the flux path between magnets 88 and 89, the flux path between magnets 90 and 85, and the flux path between magnets 89 and 90, is the primary force that attracts and retains the fastener 100 to the magnetic device 2.

Figure 4:
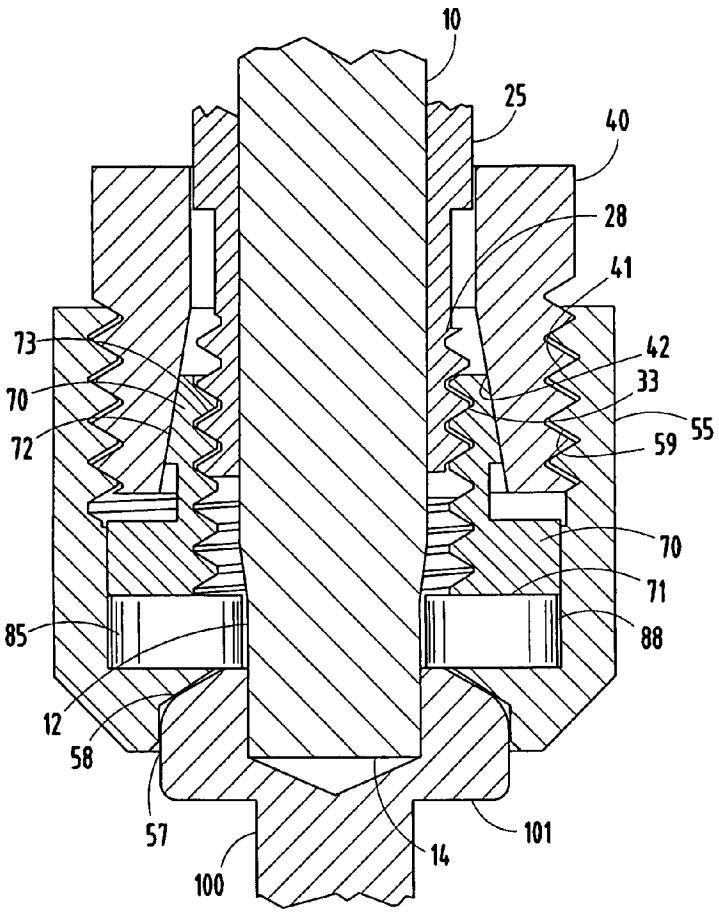
FIG. 4 is a cross-sectional view of the magnetic device shown in FIG. 1 taken through line IV—IV in FIG. 1.

The magnets 85, 86, 87, 88, 89, 90 are shown arranged equiangularly around proximate end 12 of bit 10. With reference to FIGS. 2 and 4, the magnets 85, 86, 87, 88, 89, 90 are adjacent to the bottom surface 71 of keeper 70. At least a portion of the bottom surface 71 of keeper 70 is magnetized. Holder 55 secures keeper 70 and magnets 85, 86, 87, 88, 89, 90. Holder 55 has an aperture 57 and a locator 58. Locator 58 locates fastener head 101 at the proximate tip 12 of bit 10. Locator 58 also protects magnets 85, 86, 87, 88, 89, 90 from wear during use of the magnetic device 2. When the magnetic device 2 retains a fastener 100 while fastener driving assembly 1 drives fastener 100 into a work piece, the driver assembly 1 typically exerts a lot of force on fastener head 101 and magnets 85, 86, 87, 88, 89, 90. Locator 58 protects magnets 85, 86, 87, 88, 89, 90 during the driving process. Locator 58 is shown to be an integral part of the holder 55 in the present embodiment. However, locator 58 does not have to be a part of holder 55. According to alternate embodiments, the locator 58 may be a separate component of magnetic device 2 or the magnetic device 2 may not include a locator.

According to the first embodiment, the location of magnetic device 2 on fastener driving assembly 1 shown in FIGS. 1–4 may be adjusted longitudinally (axially) along the length of bit 10. Inner sleeve 25 surrounds bit 10. Inner sleeve 25 has exterior threads 33. Keeper 70 has interior threads 73 that matingly engage threads 33. Keeper 70 is threaded onto inner sleeve 25. Keeper 70 interacts with inner sleeve 25 to adjust the location of magnetic device 2 along the longitudinal length of bit 10. Keeper 70 is rotatable relative to inner sleeve 25 to match the location of magnetic device 2 to the length of bit 10. Specifically, the position of the magnets 85, 86, 87, 88, 89, 90 and the magnetic keeper 70 within holder 55 is adjustable along the longitudinal (axial) length of bit 10 to achieve a desired location for magnets 85, 86, 87, 88, 89, 90 and keeper 70 for use with a particular length of bit 10.

Non-magnetic holder 55 secures keeper 70 and magnets 85, 86, 87, 88, 89, 90 in place on magnetic device 2. Holder 55 has interior threads 59. Clamping sleeve 40 has exterior threads 41 that matingly engage threads 59. Holder 55 is adjustable in relation to clamping sleeve 40. When the keeper 70 is moved along the length of inner sleeve 25 to adjust the position of magnets 85, 86, 87, 88, 89, 90 and keeper 70, holder 55 is moved along the length of clamping sleeve 40 so that keeper 70 and holder 55 are on either side of magnets 85, 86, 87, 88, 89, 90. Magnets 85, 86, 87, 88, 89, 90 must be in close relation to the magnetic bottom surface portion of keeper 70 so magnetic flux paths 92, 93, 94, the magnetic flux path between magnets 88 and 89, the magnetic flux path between magnets 90 and 85, and the magnetic flux path between magnets 89 and 90 may form between the first magnet of each pair of adjacent magnets with alternating poles, the magnetic portion of keeper 70, the second magnet of each pair of adjacent magnets with alternating poles, and fastener 100.

After the locations of keeper 70 along inner sleeve 25 and holder 55 along clamping sleeve 40 are adjusted, clamping sleeve 40 is tightened by screwing clamping sleeve 40 further into holder 55 so that there is a tight fit between the interior taper 42 of clamping sleeve 40 and the exterior taper 72 of keeper 70. Clamping sleeve 40 is secured tightly around keeper 70 and between keeper 70 and holder 55 such that clamping sleeve 40 ensures that the magnetic device 2 is secured to inner sleeve 25 and that the magnetic device 2 has minimal movement in relation to inner sleeve 25 during driving operations. The slits 29, 30, 31, and 32 in collet 28 of inner sleeve 25 assist in obtaining a secure fit between keeper 70 and inner sleeve 25. The slits 76, 77, 78, and 79 in collet 75 of keeper 70 also assist in obtaining a secure fit between keeper 70 and inner sleeve 25.

Figure 5:
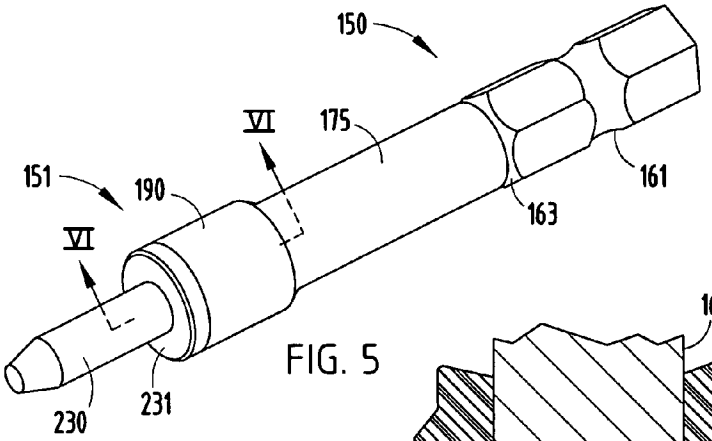
FIG. 5 is a perspective view of a fastener driving assembly embodying a magnetic device according to a second embodiment of the present invention.
Figure 6:
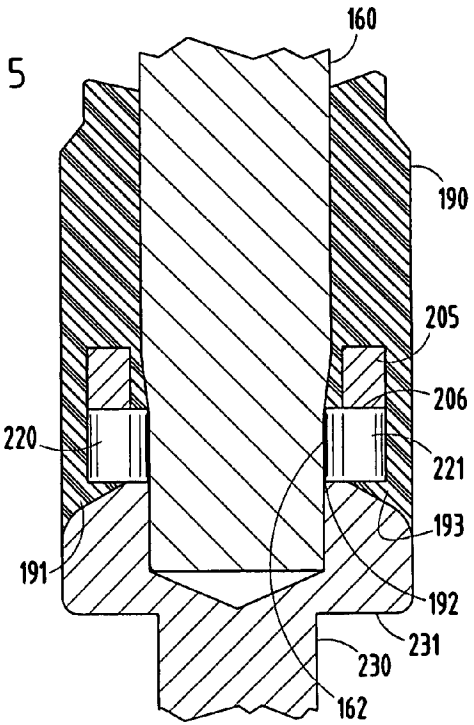
FIG. 6 is a cross-sectional view of the magnetic device shown in FIG. 5 taken through line VI—VI of FIG. 5.

Referring to FIGS. 5 and 6, a fastener driving assembly 150 is shown embodying an alternate second embodiment of the magnetic device 151. Magnets are arranged around proximate end 162 of bit 160 in the embodiment, shown in FIGS. 5 and 6, similar to the magnets arranged around proximate end 12 of bit 10 in the first embodiment shown in FIGS. 1–4. The bit 160 of fastener driving assembly 150 has a distal end 161. The holder 190 is at the proximate end 162 of bit 160. Holder 190 is non-magnetic. The fastener 230 is at the base 191 of holder 190. With reference to FIG. 6, holder 190 is molded or otherwise cast around the magnets 220, 221, and the four additional magnets not visible in FIG. 5 or 6, and the keeper 205. Magnets 220, 221, and the four additional magnets not visible in FIG. 5 or 6, may be comprised of Neodimium, Boron, or one or more other high magnetic-power materials. Keeper 205 is ring-shaped and encircles the proximate end 162 of bit 160. At least a portion of keeper 205, including a portion of the bottom surface 206 of keeper 205, is magnetic.

The magnetic device 151 according to the second embodiment is made by molding the holder 190 around keeper 205, magnets 220, 221, the four magnets not visible in FIG. 5 or 6, and bit 160. Molding of holder 190 may be accomplished by casting urethane potting resin into a mold or injection molding a plastic. The holder 190 may be molded directly onto the bit 160 such that the entire fastener driving assembly 150 is permanently attached thereto and may be discarded after the bit wears out. Alternatively, the holder 190 may be molded around magnets 220, 221, the four magnets not visible in FIG. 5 or 6, keeper 205, and a shaft. After the molding process is complete, the shaft is removed and bit 160 is inserted in the shaft's place. Whenever a bit wears out, the worn out bit can be replaced with a new bit. Holder 190 has an aperture 192. Holder 190 may also have a locator 193 for the fastener head 231. However, it is not necessary that locator 193 be part of holder 190. The locator 193 may be a separate component of magnetic device 151 or magnetic device 151 may not include a locator.

In addition to holder 190, an inner sleeve 175 may also be molded. In the ideal case, the inner sleeve 175 abuts the shoulder 163 of bit 160. The inner sleeve 175, however, may not reach the shoulder 163 of bit 160.

The magnetic device 151 according to the second embodiment, as visible in FIGS. 5 and 6, is not longitudinally adjustable along the axial length of bit 160. Instead, the components of magnetic device 151 are molded and fixed in place.

Accordingly, the magnetic device 2 or 151 advantageously attracts and retains fasteners 100 or 230 in place to allow a process operation, such as a drilling process, to be performed. The magnetic device efficiently utilizes an axial, magnetic force to attract and retain a fastener. Further, the magnetic device utilizes focused flux to attract and retain a fastener. The magnetic device does not magnetize the fastener to such a degree that the fastener's attraction to other magnetic objects in its vicinity, such as a fastener feeder or container, impairs the magnetic device's ability to reliably attract and retain the fastener.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A magnetic device for attracting and retaining a fastener, said device comprising:

a bit having a proximate end adapted for engagement with a fastener;

a generally ring-shaped keeper surrounding at least a portion of said proximate end of said bit, said keeper having a bottom surface and a magnetic portion at at least some portion of said bottom surface of said keeper;

at least one pair of magnets adjacent to at least some part of said magnetic portion of said bottom surface of said keeper and arranged around said proximate end of said bit such that all magnets arranged around said proximate end of said bit have alternating poles and such that an even number of magnets is arranged around said proximate end of said bit, each pair of magnets having first and second magnets with alternating poles wherein said at least one pair of magnets providing magnetic flux to said keeper and said fastener, and each pair of adjacent magnets providing a closed magnetic flux path through the first magnet of said pair, said keeper, the second magnet of said pair, and said fastener; and a non-magnetic holder at least partially surrounding said bit, said holder securing said keeper and said at least one pair of magnets.

2. The magnetic device of claim 1 wherein said one pair consists of one pair of crescent shape magnets.

3. The magnetic device of claim 1 wherein said at least one pair of magnets comprises three pairs of circular magnets.

4. The magnetic device of claim 1 wherein said bit is not magnetized.

5. The magnetic device of claim 1 wherein said holder has a non-magnetic locator for said fastener.

6. The magnetic device of claim 1 wherein the holder is axially adjustable relative to said bit.

7. The magnetic device of claim 1 further comprising:

an inner sleeve adjacent to a portion of said bit and surrounding a portion of said bit, said inner sleeve having a proximate end and a distal end, said bit having a distal end; and a shoulder on said distal end of said bit and a top shape on said distal end of said inner sleeve wherein said shoulder on said distal end of said bit mates with said top shape on said distal end of said inner sleeve.

8. The magnetic device of claim 7 further comprising:

a clamping sleeve for securing said holder and said keeper to said inner sleeve, wherein said holder is adjustable relative to the clamping sleeve, said keeper is adjustable relative to said inner sleeve, and said keeper is adjustable relative to said clamping sleeve.

9. The magnetic device of claim 8 wherein said holder has interior threads and said clamping sleeve has exterior threads, said inner sleeve has exterior threads and said keeper has interior threads, and said keeper has an exterior axial taper in the direction of said distal end of said bit, and said clamping sleeve has an interior axial taper in the direction of said distal end of said bit.

10. The magnetic device of claim 1 wherein said holder is a molded material.

11. The magnetic device of claim 10 further comprising a molded inner sleeve.

12. A magnetic device for attracting and retaining a fastener, said device comprising:

a bit comprising a proximate end adapted for engagement with a fastener;

a generally ring-shaped keeper, said keeper surrounding a portion of said bit, said keeper having a bottom surface and a magnetic portion at at least some portion of said bottom surface of said keeper;

at least one pair of magnets, said at least one pair of magnets adjacent to at least some part of said magnetic portion of said bottom surface of said keeper, said at least one pair of magnets arranged around said proximate end of said bit such that all magnets arranged around said proximate end of said bit have alternating poles and such that an even number of magnets is arranged around said proximate end of said bit, each pair of magnets having first and second magnets with alternating poles, wherein said at least one pair of magnets providing magnetic flux to said keeper and said fastener, and each pair of adjacent magnets providing a closed magnetic flux path through a first magnet of said pair, said keeper, a second magnet of said pair, and said fastener;

a non-magnetic holder for securing the keeper and at least one pair of magnets, said holder at least partially surrounding said bit and having a generally cylindrical enclosure and a base.

13. The magnetic device of claim 12 wherein said one pair consists of one pair of crescent shape magnets.

14. The magnetic device of claim 12 wherein said at least one pair of magnets comprises three pairs of circular magnets.

15. The magnetic device of claim 12 wherein said bit is not magnetized.

16. The magnetic device of claim 12 wherein said holder has a non-magnetic locator for locating said fastener.

17. The magnetic device of claim 12 wherein said base has an aperture for receiving a fastener.

18. The magnetic device of claim 12 wherein said holder is axially adjustable relative to said bit.

19. The magnetic device of claim 12 further comprising:

an inner sleeve adjacent to a portion of said bit and surrounding a portion of said bit, said inner sleeve having a proximate end and a distal end, said bit having a distal end; and a shoulder on said distal end of said bit and a top shape on said distal end of said inner sleeve, wherein said shoulder on said distal end of said bit mates with said top shape on said distal end of said inner sleeve.

20. The magnetic device of claim 19 further comprising:

a clamping sleeve for securing said holder and said keeper to said inner sleeve, wherein said holder is adjustable relative to the clamping sleeve;

said keeper is adjustable relative to said inner sleeve; and said keeper is adjustable relative to said clamping sleeve.

21. The magnetic device of claim 20 wherein:

said holder has interior threads and said clamping sleeve has exterior threads;

said inner sleeve has exterior threads and said keeper has interior threads; and said keeper has an exterior axial taper in the direction of said distal end of said bit, and said clamping sleeve has an interior axial taper in the direction of said distal end of said bit.

22. The magnetic device of claim 21 wherein said holder is a molded material.

23. The magnetic device of claim 22 further comprising a molded inner sleeve.

* * * * *